United States Patent [19]

Fillus et al.

[11] 4,350,857

[45] Sep. 21, 1982

[54] ILLUMINATED INDUSTRIAL MEMBRANE SWITCH

[75] Inventors: Gary C. Fillus, South Milwaukee, Wis.; Eric L. Long, Northbrook, Ill.

[73] Assignee: Allen-Bradley Company, Milwaukee, Wis.

[21] Appl. No.: 193,489

[22] Filed: Oct. 3, 1980

[51] Int. Cl.[3] ..... H01H 9/20

[52] U.S. Cl. ..... 200/314; 200/159 B

[58] Field of Search ..... 200/314, 5 A, 159 B

[56] References Cited

U.S. PATENT DOCUMENTS

| | | | |
|---|---|---|---|
| 2,853,565 | 9/1958 | Arthur et al. | 200/314 |
| 2,927,988 | 3/1960 | Powell | 200/159 |
| 3,170,057 | 2/1965 | Kane et al. | 200/314 |
| 3,503,031 | 3/1970 | Nyhus et al. | 338/99 |
| 3,539,749 | 11/1970 | MacPheat | 200/159 |
| 3,643,041 | 2/1972 | Jackson | 200/5 A |
| 3,676,615 | 7/1972 | Wiedmer | 200/1 R |
| 3,699,294 | 10/1972 | Sudduth | 200/166 C |
| 3,770,925 | 11/1973 | Nelson et al. | 200/168 C |
| 3,770,926 | 11/1973 | Wanner | 200/166 SD |
| 3,773,997 | 11/1973 | Evans et al. | 200/159 B |
| 3,773,998 | 11/1973 | Seeger, Jr. et al. | 200/159 B |
| 3,777,082 | 12/1973 | Hatley et al. | 200/159 B |
| 3,969,595 | 7/1976 | Johnson | 200/159 B |
| 3,987,259 | 10/1976 | Larson | 200/5 A |
| 4,013,856 | 3/1977 | Joss et al. | 200/314 |
| 4,060,703 | 11/1977 | Everett, Jr. | 200/5 A |
| 4,065,649 | 12/1977 | Carter et al. | 200/5 A |
| 4,088,855 | 5/1978 | Emery | 200/16 A |
| 4,117,438 | 9/1978 | Kim et al. | 336/75 |
| 4,156,802 | 5/1979 | Gilano et al. | 200/5 A |
| 4,158,115 | 6/1979 | Parkinson | 200/5 A |

*Primary Examiner*—Willis Little

*Attorney, Agent, or Firm*—Quarles & Brady

[57] ABSTRACT

An electrical switch is provided with a switch operator having a resilient pad on its distal end, the operator being mounted for axial movement in an operator housing to actuate contacts deposited in a double spiral pattern on a substrate coupled to the operator housing. The operator tip is moved first to contact the front side of a flexible membrane which has a conductive shorting patch on its back side, and which is separated from the contacts by a spacer. The operator pad is then moved further to deflect the membrane and close the gap formed between the shorting patch and the switch contacts, the travel of the operator and the action of the pad providing a sensation of feel to the user. The switch is constructed in single units and in arrays, and a lighting circuit is added by forming a bulb socket in the switch operator with spring tipped contact members that engage lighting terminals in an individual switch on lighting contact areas on the front side of a membrane used in the array.

10 Claims, 7 Drawing Figures

ILLUMINATED INDUSTRIAL MEMBRANE SWITCH

BACKGROUND OF THE INVENTION

1. Field of the Invention

The invention relates to the field of control switches of the type used in control panels and switch stations in an industrial environment.

2. Description of the Prior Art

Industrial control switches are characterized by different kinds of operators. In a push button control such as disclosed in Nelson et al, U.S. Pat. No. 3,770,925 issued Nov. 6, 1973, a momentary operator normally provides switch actuation for a short time. In a selector switch, on the other hand, such as disclosed in Wanner, U.S. Pat. No. 3,770,926, issued Nov. 6, 1973, an operator is maintained in one of several selectable positions for a typically longer period.

From these basic control units, other types have been developed through the addition of a secondary circuit to light the switch operator. A push button, for example, may be either constantly lighted or may be the push-to-test type, wherein the operator is lighted upon the successful actuation of the primary switch contacts.

One particular class of industrial switches with these various types of operators must be rugged, reliable, and sealed against the intrusion of oil and other contaminants encountered in the industrial environment. Prior devices of this type such as disclosed in U.S. Pat. Nos. 3,770,925 and 3,770,926 have relied on mechanical contacts that have been sealed within contact blocks coupled to the switch operators.

With the introduction of solid state, digital control equipment there is a need for improved sealed control switches with low-bounce contacts for switching at d-c logic signal levels such as 5 volts, 15 volts and 30 volts.

In the field of digital office equipment, touch-actuated switching panels have been developed to replace traditional key-operated panels. These newer panels commonly involve several thin sheets of an insulating material such as Mylar. A spacing sheet is used between two other sheets on which conductive areas have been formed by screen printing or other deposition processes. The spacing sheet contains openings to allow the conductive areas on the spaced apart sheets to contact one another when pushed together at the touch of an operator. Such pressure sensitive switching panels have their functional labels arranged in patterns and arrays resembling keyboards, yet such panels are flush with the surface of the control panel or equipment utilizing them. Such panels have the advantage of sealed contacts, but in an industrial environment lack the tactility or other form of feedback to the human operator that is provided by traditional industrial controls. Such membraneous, touch-sensitive switching panels are by the nature of their construction more readily adapted to arrays and have not provided suitable individual switches that can be located apart from control panels.

SUMMARY OF THE INVENTION

The invention is provided in an electrical switch of the type that combines an operator assembly, having the look and feel desired in the manufacturing environment, with a contact assembly having a thin-layered construction of the general type seen in membrane switches. The invention resides in the modification of a non-lighted electrical switch to provide an illuminated switch of this type without affecting the switch profile or its advantageous operating characteristics. The modified structure provides the further advantage of convenient access to a light bulb for inspection and replacement, if necessary.

The unmodified switch is more particularly described in a copending application of Long et al filed concurrently herewith and entitled "Industrial Membrane Switch." This switch has an operator assembly that includes an operator housing with a front end, a rear end, and an opening therethrough from a housing entrance at the front end to a housing exit at the rear end. An operator is mounted for movement within the housing, the operator having a distal end that actuates the contact assembly.

The contact assembly includes a contact support structure which supports a substrate and which is coupled to the operator housing to isolate the contacts from the outside environment. A pair of spaced apart contact termination areas are formed on a front side of the substrate. A flexible membrane is mounted on the substrate with spacing means interposed between the front side of the substrate and the membrane to provide a gap between the contact termination areas on the substrate and a shorting patch disposed on an opposing, back side of the membrane. A pair of switch terminals are electrically connected to respective termination areas on the substrate.

To provide a lighting circuit in such a switch, the operator is further defined as having a plunger portion in which a bulb socket is formed and having a cap portion that fits over the socket end of the plunger portion. A pair of contact members are disposed within the plunger socket and extend to the outside of the plunger into the opening within the operator housing. There, a pair of bulb contact springs are connected to respective contact members, each extending to the exit of the operator housing. A second pair of terminals are mounted on the contact support structure, each terminal being engaged by a respective bulb contact spring. The lighting circuit may be constantly lighted in a pilot light, or logically conditioned upon actuation of the primary switch circuit in a lighted push button switch.

The invented switch construction provides individual membrane switch units not seen in the prior art, and it is also readily adapted to the production of switch arrays arranged in matrices of two-by-four, three-by-three, three-by-four and four-by-four, as examples. An array is provided by producing the selected number of pairs of first contact termination areas on a circuit board, by producing a corresponding number of shorting patches in matching configuration on the membrane, and by producing a corresponding number of second termination areas for the lighting circuits on the front side of the membrane. Circuit paths are formed on the circuit board and membrane to connect the first and second termination areas, respectively, to sets of terminals mounted on the circuit board. Where a single circuit board termination is desired, the invention provides for extending the circuit paths on a membrane extension across the back of the circuit board to connect to the back side of a double edge connector.

It is one object of the invention to provide a heavy duty, illuminated industrial switch with low-bounce switch contacts that occupy a minimum of space and are easily sealed against contaminants in the environment.

It is a further object of the invention to provide such switches with a few simple parts to form a lighting circuit within the switch without altering its profile.

It is a further object of the invention to provide a lighted switch structure in which both switch contacts and bulbs are easily replaced, if necessary.

It is a further object of the invention to provide an array of lighted switches and pilot lights having a plurality of lighting and switching contacts formed in a single circuit board assembly.

The foregoing and other objects and advantages of the invention will appear from the following description. In the description reference is made to the accompanying drawings which form a part hereof, and in which there is shown by way of illustration two embodiments of the invention. Such embodiments do not necessarily represent the full scope of the invention, however, and reference is made to the claims for determining this scope.

DESCRIPTION OF THE PREFERRED EMBODIMENTS

Figure 1:
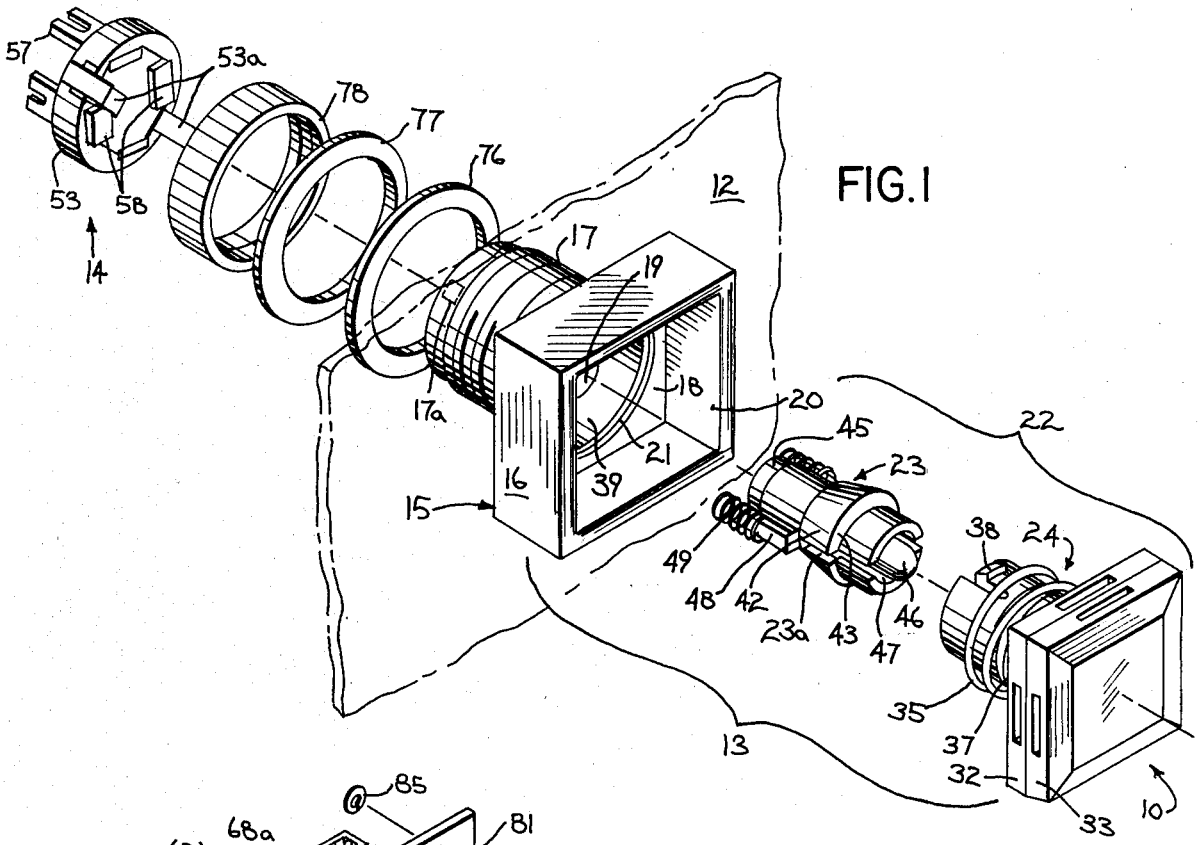
FIG. 1 is an exploded perspective view of an illuminated push button switch that embodies the present invention.
Figure 2:
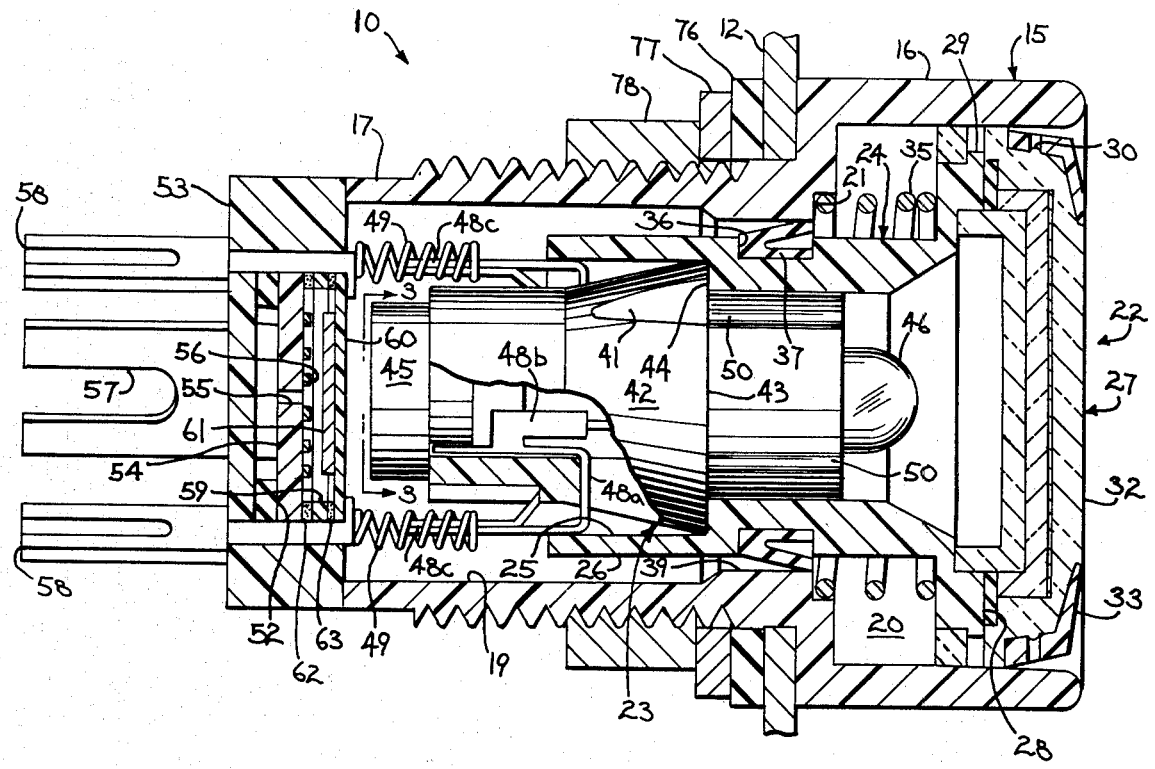
FIG. 2 is a sectional view of the assembled switch of FIG. 1, looking vertically downward through a horizontal plane that bisects the switch, with certain interior parts being broken away.

Referring to FIGS. 1 and 2, an electrical switch 10 adapted for attachment to a control panel 12 or other supporting structure, includes an operator assembly 13 and a contact assembly 14. The operator assembly 13 is housed in a bezel 15 molded from a thermoplastic insulating material and having a forward box-shaped portion 16 with an entrance into a rectangular opening 20, which is framed by four rounded edge surfaces. A barrel portion 17 of the bezel 15 extends from a rear wall 18 of the rectangular portion 16, the barrel portion 17 having a cylindrical opening 19 that extends from the rectangular opening 20 to a housing exit at the rear end of the bezel 15. An annular spring seat 21 is formed in the rear wall 18 of the rectangular portion 16 around the entrance into the barrel opening 19.

As seen in FIG. 1, an operator 22 includes an elongated, cylindrical plunger 23 which has been removed from a cap assembly 24. Referring to FIG. 2, a plunger-receiving cavity 25 is formed in a hollow, cylindrical cap stem 26 to receive the plunger 23 when the operator 22 is assembled. A complex lens assembly 27 with a plurality of light-transmitting members is mounted on a rectangular flange 28 at the front end of this cap stem 26. The lens assembly 27 forms a head for the operator cap 24 that fills the rectangular opening 20 in the bezel 15 and is flush with the front edges of the bezel 15. The head of the cap 24 could, of course, be positioned rearwardly from the front edges of the bezel 15 to provide a guard for the operator 22. As seen in FIGS. 1 and 2, the lens assembly 27 includes a rectangular lens frame 33 that snap fits over projections 30 formed on the lens 32 and has a rectangular opening in which a portion of the lens 32 is received. The lens 32 in turn snap fits over projections 29 formed on the rectangular flange 28 (as seen in FIG. 2).

When the operator button is assembled in the bezel 15 as seen in FIG. 2, a return spring 35 is captured between the spring seat 21 and the cap stem flange 28. The return spring 35 is compressed when the operator 22 is moved through the opening 19, 20 towards the rear of the bezel 15, and the spring 35 stores energy that exerts a return force on the head of the operator cap 24, when the operator 22 is released by a user. The operator cap stem 26 has a channel 36 encircling it midway between the stem flange 28 at its forward end and the opening into the plunger cavity 25 at its rear end. A U-cup seal 37 of thin elastomeric material is fitted into this channel, the seal 37 tapering from a wider effective width to a narrower effective width as it extends rearwardly through the bezel opening 19. This seal 37 protects the bezel opening 19 against the intrusion of oil or other contaminants.

Figure 3:
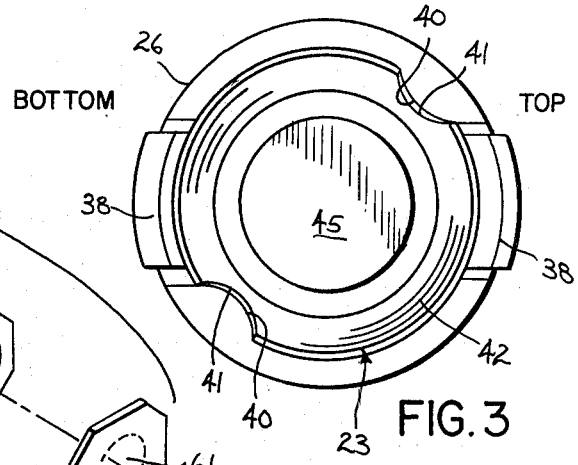
FIG. 3 is a rear end view of a push button operator without the lighting contacts taken in the plane indicated by line 3—3 in FIG. 2.

As seen in FIGS. 1 and 3, the cap stem 26 is formed with two flexible barbed fingers 38, to hold the operator 24 in position within the bezel 15. The barbed fingers 38 are formed by a plurality of slots extending axially into the cap stem 26 from its rear end, the stem 26 being terminated in four segments, two of which form the retaining fingers 38. The barbed ends of these fingers 38 snap over an integrally formed annular retaining ring 39 seen partially in perspective in FIG. 1, and seen in cross section in FIG. 2, where the barrel opening 19 is narrowed at its entrance.

In FIG. 3, two other oppositely disposed segments carry rounded, inwardly extending projections 40 that are radially spaced 180 degrees apart. These projections 40 are received in detents 41 (seen best in FIG. 2) formed in a tapered annular flange 42 seen best in FIG. 1 where it encircles the middle of the plunger 23. The detents 41 are also spaced 180 degrees apart, as seen in FIG. 3, to cooperate in keying the rotational position of the plunger 23 within the stem cavity 25. As seen best in FIG. 1, the beveled flange 42 also forms an annular surface 43 at its forward end, and in FIG. 2 with the plunger 23 inserted in the stem cavity 25, this surface 43 engages an annular stop surface 44 formed in the interior of the cap stem 26. The upper end of the plunger 23 forms ribs 50 that provide an interference fit against the surface defining the upper end of the plunger-receiving cavity 25, to securely hold the plunger 23 against axial displacement relative to cap stem 26. The plunger 23 is completed by a pad 45 of resilient insulating material which is mounted on its distal end and extends toward the housing exit.

As seen in FIGS. 1 and 2, a lighting circuit is provided for a bulb 46, which is inserted in a bulb-receiving cavity 47 in the forward end of the plunger 23. A pair of brass bulb contact members 48 of complex shape are disposed in the bulb cavity 47 with crossbar portions 48*a* supported in oppositely disposed notches 23*a* (FIG.

1) in the cylindrical side wall of the plunger. From this crossbar portion 48*a*, another portion of each contact member 48 extends downwardly into the bulb socket and has a pair of forwardly folded ears 48*b* (one being broken off in FIG. 2) receiving the base end of a bulb 46, which is preferably a T 1¾ wedge base lamp. The bulb contact members 48 each have a stab portion 48*c* extending outside the plunger 23 and the plunger-receiving cavity 25, into the opening in the barrel and towards the exit therein. A beryllium-copper alloy coil spring 49 is mounted on the stab portion 48*c* of each bulb contact member 48 and extends toward the exit in the barrel 17 along a central spring axis that is parallel to the central plunger axis.

Figure 4:
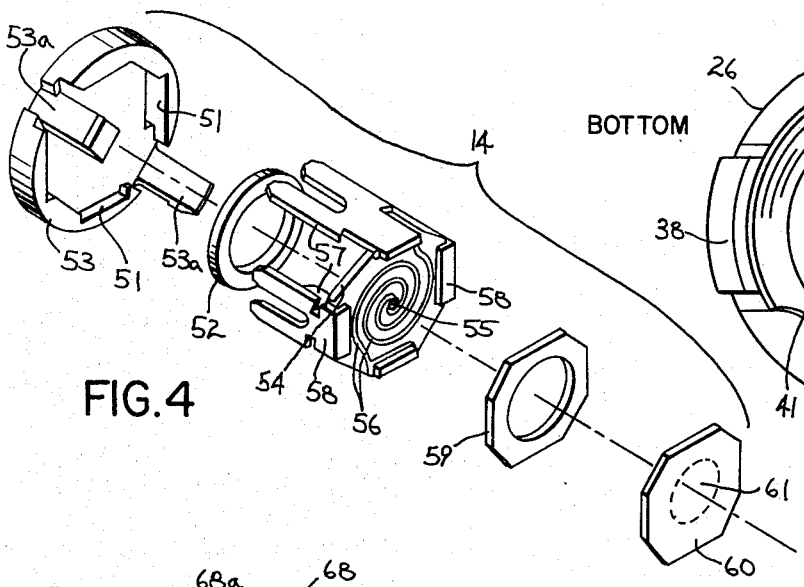
FIG. 4 is a detail exploded view in perspective of a contact assembly that is the upper left component seen in FIG. 1.

Referring to FIG. 4, the contact assembly 14 includes a contact support cup 53 of thermoplastic insulating material with an octagonal cavity that forms eight interior walls. Four rectangular slots 51 are formed in the bottom of the cup and arranged in opposing pairs along orthoganal axes. The slots 51 are adjacent to four corresponding parallel wall surfaces which alternate with obliquely disposed wall surfaces around the octagonal cavity. A breather ring 52 of elastomeric material is disposed in the bottom of the cup 53 and an octagonal substrate 54 is disposed over the breather ring 52 as seen in cross section in FIG. 2. The substrate 54 has a centrally located aperture 55 for reasons that are more fully explained in a copending application of Baran et al filed concurrently herewith and entitled "Industrial Membrane Switch with Breather."

Referring again to FIG. 4, two spiralling termination areas 56 are deposited on the front face of the substrate 54, which is made of an insulating glass-epoxy material with electrolytic copper on one side, using an etching technique of a type well known in the art of making printed circuit boards. The etched circuit pattern is then electroplated with nickel and gold. The ends of the spiralling termination areas 56 are electrically connected to the upper ends of a pair of primary switch terminals 57 which are anchored near the outside edge of the substrate 54 and which are radially spaced 180 degrees apart. These switch terminals 57 have neck-and-shoulder portions connecting their upper ends to two-legged portions. Positioned along the outside edges of the substrate 54 and radially spaced ninety degrees from each of the primary switch terminals 57 are a pair of lighting circuit terminals 58 having neck portions connecting their bent-over upper ends to two-legged portions. As seen in FIG. 2, the terminals 57, 58 have their neck portions positioned in the slots 51, where their two-legged portions are twisted about the longitudinal axes of the terminals 57, 58 to anchor them in position in the support cup 53.

Referring to FIGS. 2 and 4, an insulating, octagonal, Mylar spacer 59 with a thickness of five mils is adhesively secured to the front face of the substrate 53 between the outside edges of the spiral configuration and the upper ends of the terminals 57, 58, the spacer 59 having a circular aperture in it for access to the contact termination areas 56. On top of the spacer 59 a flexible membrane 70 of insulating material is adhesively secured, the membrane 60 in this instance being an octagonal sheet of Mylar with a thickness of five mils and with a circular shorting patch 61 formed on its back side by screen printing or otherwise depositing a dot of conductive ink or paint thereon. With the membrane 60 in position on the spacer 59, as seen in FIG. 2, the shorting patch 61 opposes the contact termination areas 56 but is spaced apart by a gap of approximately twelve mils occupied by the spacer 59 and the two layers 62, 63 of adhesive on opposite sides of the spacer 59. The thicknesses of the layers have been exaggerated in FIG. 2 as an aid in disclosing the invention.

Referring to FIGS. 1 and 4, the contact cup 53 has integrally formed, coupling members 53*a* with barbed ends that are received in a pair of rectangular detents 17*a* formed within the interior of barrel 17, one of the detents being seen in phantom in FIG. 1. The barbs extend radially outward with the coupling members being flexed towards one another as they are forced axially into the exit end of the barrel 17. The result of this arrangement is that the contact cup 53 abuts the exit end of the barrel 17, as seen in FIG. 2, to seal the conductive elements 56 and 61 within an insulated switch housing.

With the contact assembly 14 abutting the exit end of the barrel 17, as seen in FIG. 2, the bulb contact springs 49 will rest on the bent-over ends of the lighting circuit terminals 58. Projections or dimples may be formed on the bent-over ends to seat the springs 49. The resilient pad 45 is spaced from the exit of the barrel 17, so that it moves through a pre-travel distance before engaging the front side of the membrane 60. The pad 45 is then moved through an additional distance to deflect the membrane 60 and bridge the gap between the spiral contact areas 56 using the shorting patch 61 as the bridging conductive element. The double spiral configuration of the contact areas 56 eliminates potential blind spots at which deflection of the shorting pad 61 might fail to make a bridging connection; however, this desirable feature is not absolute to the practice of the invention in its broader aspects. When the membrane 60 is deflected, air is circulated through the aperture 55 in the substrate 54 to the void in the middle of the breather ring 52, and when the operator 22 is released the air returns to the switch air gap between the substrate 54 and the membrane 60 to break contact. Besides the measure of pretravel, several other factors contribute to a sense of feel to the user when the switch 10 is operated. The return spring 35 extends a sufficient distance to provide a measure of overtravel for the switch operator 22, and the resilient pad 45 emulates, to some extent, the action of the user's fingertip.

Figure 5:
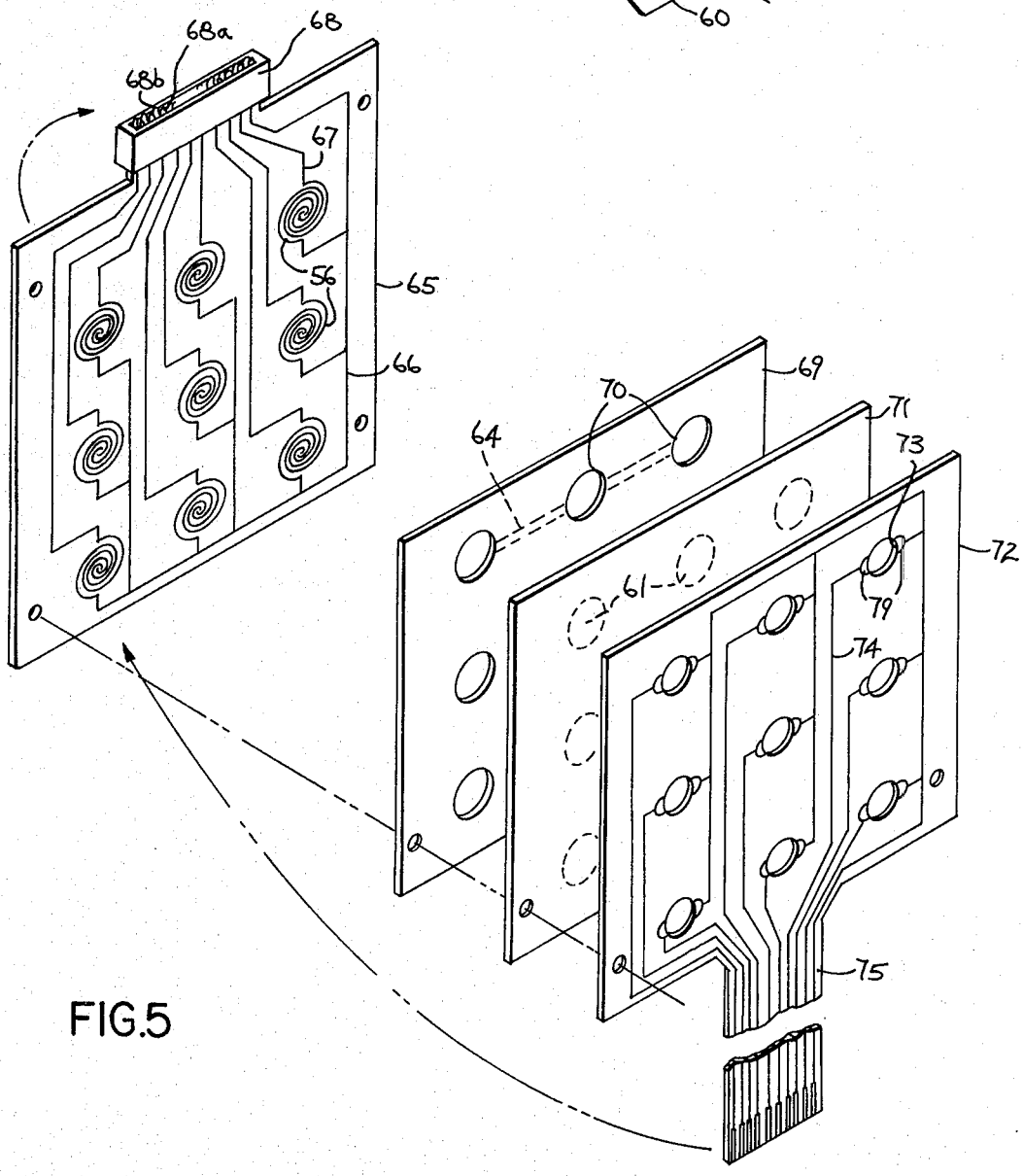
FIG. 5 is an exploded perspective view of a circuit board assembly seen in assembled form in FIG. 6.

As seen in a second embodiment in FIG. 5, the structure and method of making the contact assembly 14 is adapted to an array of contacts for a plurality of switches. A plurality of double spiral configurations 56 in a three-by-three, two-by-four, three-by-four, four-by-four, or other matrix configuration is etched in the manner described above on a circuit board 65 which serves as the substrate for the array. The pattern seen in FIG. 5 is a three-by-three common bus arrangement where one termination area 56 in each double spiral configuration is connected to a common ground circuit path 66 while the other contact termination area 56 in each spiral configuration has its own respective circuit path 67 leading to a terminal 68*a* in an edge connector 68 mounted on one edge of the circuit board 65. Besides a common bus configuration, other configurations are possible, such as a set of circuit paths connecting pairs of spiral switch termination areas 56 to binary coded I/O terminals in the edge connector 68. A spacing sheet 69 of five mils thickness with circular apertures 70 in a corresponding array is then adhesively mounted on the circuit board 65. This spacing sheet 69 has channels 64 connecting the apertures 70 in each row to provide a path for circulating air from an actuated switch to and from its neighbors. Next, a membrane overlay 71 of five mils thickness with shorting patches 61 formed in corresponding configuration is adhesively secured to the spacer 69 so that each shorting patch 61 will oppose a respective double spiral pair of contact termination areas 56.

In the array of FIG. 5 it is convenient to provide a second overlay 72 with lighting circuit contact areas 79, the second overlay 72 being mounted on the first with adhesive or other suitable means. The lighting circuit areas 79 could also be formed on the front side of the first overlay 71. This second overlay 72 is a five mils thick, flexible membrane of Mylar with apertures 73 disposed in one-for-one correspondence with the shorting patches 61 disposed on the first overlay 71 beneath. The lighting termination areas 79 are disposed along an axis rotated ninety degrees from an axis along which the spiral termination areas 56 connect to the circuit paths 66 and 67. The lighting circuit termination areas 79 and the circuit paths 74 which connect them to the edge connector 68 are formed of copper by an etching process of the type well known in the art. Alternatively, these areas 79 and paths 74 could be screen printed as were the shorting patches 61 on the first overlay 71. The second overlay 72 has, in addition, a tail 75 on which the circuit paths 74 are extended. When using the second overlay 72, a double edge connector 68 is mounted on the circuit board, and the tail 75 is wrapped around and secured to the back side of the circuit board 65 to connect the lighting circuit paths 74 to a second group of terminals **68*b* along one longitudinal edge of the double edge connector 68. The terminals 68*a* along the other longitudinal edge connect to the circuit paths 66 and 67 on the circuit board 65**. It will be apparent to those skilled in the art that two single edge connectors could be used in place of the double edge connector, if desired.

Figure 6:
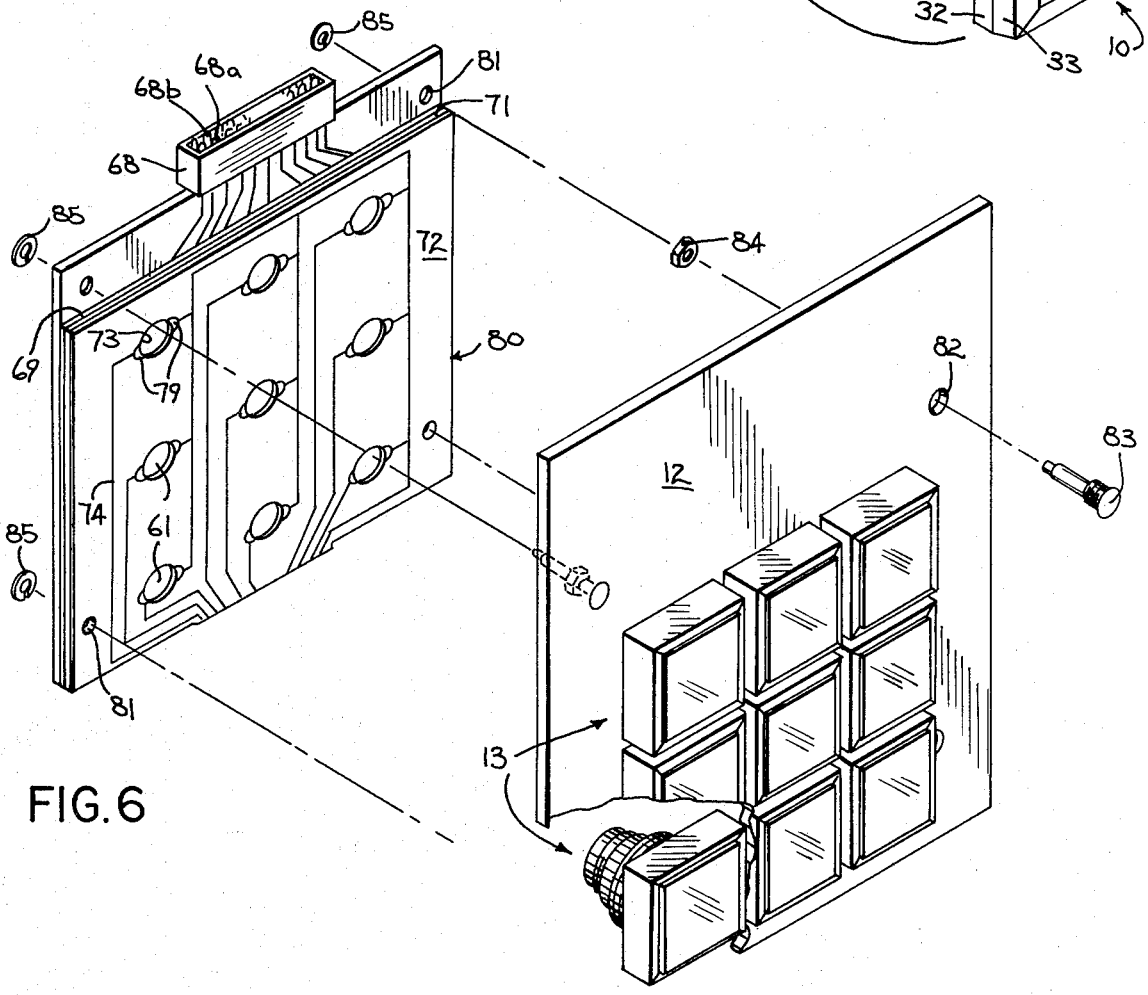
FIG. 6 is a partially exploded perspective view of an array of switch operator assemblies seen in FIG. 2, which are mounted on the circuit board assembly of FIG. 5.

Referring to FIG. 6, the circuit board assembly 80 just described is assembled with a plurality of switch operator units 13, such as push buttons, pilot lights and lighted push button units that are mounted in a control panel 12 or other supporting structure. To mount the switch operator units a plurality of circular apertures (not seen) are provided in the panel 12, with the switch operator unit 13 being positioned as seen in FIG. 2 with the back side of the rectangular portion 16 of the bezel 15 meeting the front side of the panel. Referring to FIGS. 1 and 2, an annular gasket 76 of synthetic elastomeric material and a metal washer 77 are slipped over the outside of the barrel 17 and held against the back side of the control panel by an annular lock ring 78 with an interior thread that engages a thread running around the circumference to the barrel 17. The outer surface of the lock ring 78 is knurled for a better grip.

With a plurality of operator units 13 assembled in the panel as seen in FIG. 6, the circuit board assembly 80 is attached. The circuit board assembly 80 has holes 81 in its four corners which are aligned with corresponding countersunk holes 82 in the control panel 12. Circuit board standoffs 83 are inserted through the holes in the panel 12 and sealing lock nuts 84 are threadingly turned onto the standoffs 83 until positioned against a panel gasket 86 seen in FIG. 7 on the back side of the panel 12. External prong retainers 85 are attached to the ends of the standoffs 83, which extend through the aligned holes 81 in the circuit board assembly 80, these ends being specially adapted to receive such retainers 85.

Figure 7:
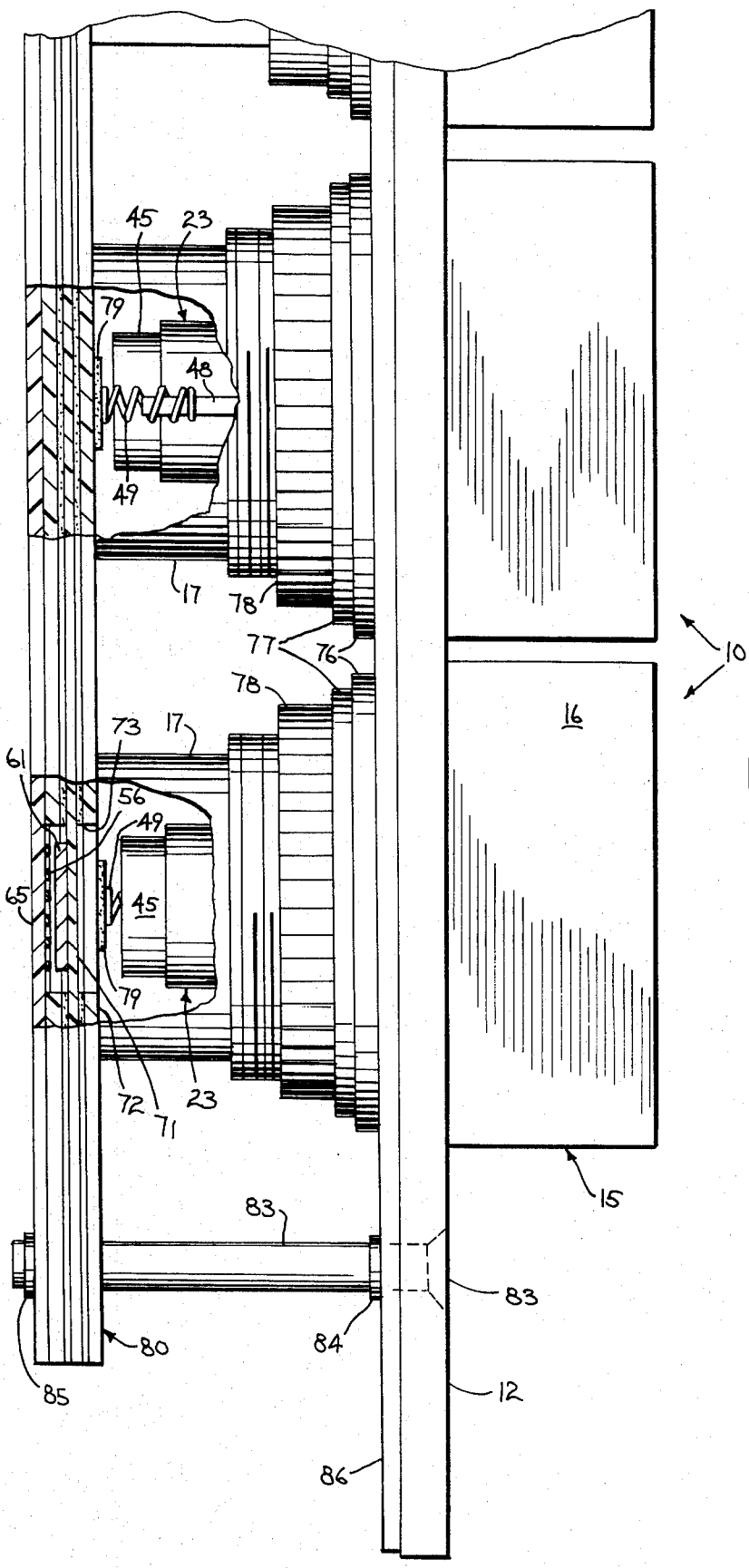
FIG. 7 is a side view in elevation showing a portion of the assembled array of FIG. 6 with parts broken away.

Referring to FIG. 7, a portion of the assembled array includes two lighted push buttons 10. The upper switch 10 is shown with one of its bulb contact springs 49 contacting one of the lighting termination areas 79 on the top overlay 72. The lower switch 10 is shown with one of its bulb contact structures removed. There it can be seen how the pad 45 on the distal end of plunger 23 is aligned to travel through a respective aperture 73 in the top overlay 72 to deflect the overlay 71 beneath it. The circuit board assembly 80 is mounted at a distance from the panel 12 where the exit ends of the bezel 15 abut the top overlay 72 to complete the seal around the contact structures formed in the circuit board assembly 80.

It can be seen that the present invention provides a switch with a lower profile than prior switches used in a manufacturing environment, yet with the look and feel desired by industrial customers. The contact assembly 14 in the individual switch completes the sealed switch structure, and is easily removed if the conductive contact areas are accidentally damaged. The contact structure is easily produced in a unitary array for use in control panels, although it should be appreciated that a plurality of individual switches of the first embodiment could also be mounted to a control panel. With the addition of a second membrane overlay 72, operator assemblies with lighting circuits can be interchangeably used with unlighted operator units of simpler construction.

While the foregoing description provides the details of making and using two embodiments of the invention, the full scope of embodiments contemplated by the invention is described by the following claims.

We claim:

1. An illuminated electrical switch which comprises:

an operator housing with a front end, a rear end and an opening therethrough from a housing entrance at the front end to a housing exit at the rear end;

an operator disposed in the opening in the operator housing, the operator extending from one end near the housing entrance to a distal end spaced inwardly from the housing exit, the operator being mounted for movement within the operator housing such that the distal end of the operator is movable toward the housing exit to actuate the switch, the operator including an axially extending plunger portion that forms the distal end, the plunger having an opposite end in which a bulb socket is formed, and the operator also having a cap portion that fits over the bulb socket end of the plunger portion;

a pair of bulb contact members disposed within the bulb socket and extending radially outward from the plunger portion into the opening within the operator housing;

a pair of bulb contact springs, each spring being mounted on a respective bulb contact member and extending towards the exit of the operator housing;

a contact support structure coupled to the operator housing;

a pair of lighting circuit terminals, each lighting circuit terminal being supported by the contact support structure, and each lighting circuit terminal being electrically connected to a respective bulb contact spring at a location corresponding to the radial extent of its respective bulb contact member to form a portion of a lighting circuit;

a substrate supported by the contact support structure, the substrate having a front side;

a pair of spaced apart contact termination areas disposed on the front side of the substrate radially inward of the electrical connections of the lighting circuit terminals to the bulb contact springs;

a pair of switch terminals, each being electrically connected to a respective termination area on the front side of the substrate; and shorting means, disposed between and spaced from the distal end of the operator and the contact termination areas, and disposed radially inward of the connections of the lighting circuit terminals to the bulb contact springs, for movement by the distal end of the operator into contact with the termination areas to close a switch circuit that is formed within a space defined by the distance between the electrical connections of the lighting circuit terminals to the bulb contact springs.

2. The electrical switch of claim 1, wherein the contact support structure is a cup of insulating material in which the substrate and the shorting means are received, the cup having means for coupling it to the operator housing to close the exit end.

3. An array of electrical switches, wherein each switch comprises:

an operator housing with a front end, a rear end and an opening therethrough from a housing entrance at the front end to a housing exit at the rear end;

an operator disposed in the opening in the operator housing, the operator extending from one end of the housing entrance to a distal end spaced inwardly from the housing exit, the operator being mounted for movement within the operator housing such that the distal end of the operator is movable towards the housing exit to actuate the switch, the operator including a plunger portion that forms the distal end, the plunger having an opposite end in which a bulb socket is formed, and the operator also having a cap portion that fits over the bulb socket end of the plunger portion;

a pair of bulb contact members disposed within the bulb socket and extending outside the plunger portion into the opening within the operator housing; and a pair of bulb contact springs, each spring being mounted on a respective bulb contact member and extending towards the exit of the operator housing;

the array of switches further comprising a contact support structure coupled to the operator housings;

the array of switches further comprising a substrate supported by the contact support structure, the substrate having a front side;

wherein a plurality of first pairs of spaced apart contact termination areas are disposed on the front side of the substrate to form an array;

the array further comprising switch terminals for a plurality of switches, each being electrically connected to a respective termination area on the front side of the substrate, and lighting circuit terminals for a plurality of lighting circuits, each pair of lighting circuit terminals being supported by the contact support structure, and each lighting circuit terminal being positioned for electrical contact with a respective bulb contact spring to form a portion of a lighting circuit;

the array further comprising shorting means, disposed between and spaced from the distal end of each operator and its associated pair of contact termination areas, for movement by the distal end of a respective operator into contact with the contact termination areas to close the circuit formed between each respective pair of switch terminals, wherein the shorting means includes a membrane spaced from the substrate with a plurality of shorting patching on its back side, each shorting patch being positioned to oppose a respective pair of contact termination areas on the front side of the substrate;

wherein there are a plurality of second pairs of spaced-apart contact termination areas disposed on the front side of the membrane to form an array, each second pair of contact termination areas being alternately disposed around the respective shorting patch relative to the electrical connections between the first pair of termination areas and the switch terminals;

the array further comprising a first set of circuit paths disposed on the substrate which connect the first pair of termination areas to the switch terminals to form a plurality of electrical switch circuits; and the array further comprising a second set of circuit paths that traverse the back side of the substrate to connect the second pair of termination areas to the lighting circuit terminals.

4. The array of electrical switches as recited in claim 3, wherein the switch terminals and the lighting circuit terminals are both included in a double edge connector disposed along one edge of the substrate.

5. The array of electrical switches as recited in claim 3, wherein the second pairs of termination areas are disposed on a second membrane overlapping the first membrane, the second membrane having a plurality of apertures in registration with the shorting patches on the first membrane, the second pairs of termination areas being disposed around these apertures.

6. The array of electrical switches as recited in claim 3, wherein the second set of circuit paths is disposed on a membrane extension that traverses the back side of the substrate.

7. An electrical switch which comprises:

an operator housing with a forward portion and with a rear portion extending therefrom, the two portions having a longitudinal opening therethrough from the housing entrance in the forward portion to the housing exit in the rear portion, and the operator housing having a spring seat around an entrance into the rear portion of the operator housing;

an operator mounted for longitudinal movement in the operator housing and including an operator cap with a head disposed within the opening in the forward portion of the operator housing and with a stem extending rearwardly therefrom into the rear portion of the housing, the stem having a cavity therein that opens towards the rear end of the operator housing, and the stem having a stop formed by a narrowing of the stem cavity, an operator plunger removably inserted into the operator stem cavity, the plunger having one end nearer to the head of the operator cap and a distal end that is farther away from the operator cap, the plunger being formed with a flange around its periphery that engages the stop within the operator stem, and the plunger having a bulb socket formed in the end nearer the head of the operator, a pair of bulb contact members disposed within the bulb socket and extending outside of the plunger into the opening within the operator housing, and a pair of bulb contact springs, each spring being mounted on a respective bulb contact member and extending toward the exit of the operator housing;

a return spring captured between the spring seat and the head of the operator cap, the spring being stressed upon the movement of the operator towards the rear of the operator housing to provide a return force in the opposite direction when the operator is released;

a contact housing that encloses the rear end of the operator housing;

a flexible membrane disposed within the contact housing;

a pair of spaced apart conductive elements disposed within the contact housing, the conductive elements being spaced in the direction of travel of the operator plunger, and at least one of the conductive elements being supported on the flexible membrane and movable in the direction of plunger travel to close the space therebetween;

a pair of switch terminals mounted on the contact housing, each switch terminal being electrically connected to a respective conductive element to form an electrical switch;

a second pair of conductive elements disposed on the front side of the flexible membrane and facing into the exit of the operator housing, each of these elements being engaged by a respective bulb contact spring; and a pair of lighting circuit terminals, each being electrically connected to a respective bulb termination area to complete a lighting circuit through the switch.

8. The electrical switch of claim 7, wherein keying means are formed within the interior of the operator stem and on the exterior of the plunger for providing proper rotational orientation of the plunger and cap when the plunger is inserted into the cap.

9. The electrical switch of claim 7, wherein the plunger forms a plurality of axially aligned ribs at its upper end tht provide an interference fit against a surface of the operator stem that defines the plunger-receiving cavity.

10. A manually operable, illuminated electrical switch, the combination comprising:

a housing that is open at its front and its rear;

a reciprocally movable, manually engageable operator cap slidably contained within and insertable from the front of the housing, the cap having a head portion closing over the front of the housing and a hollow stem portion extending rearwardly from the head portion;

a biasing srping interposed between the housing and the operator cap urging the operator cap toward the housing front;

a plunger received within the stem section of the operator cap and movable therewith, the plunger forming a distal end facing rearwardly towards the open rear of the housing and forming a bulb socket in the end nearer to the head of the operator;

a pair of bulb contact members disposed within the bulb socket and extending outside the plunger into the opening within the operator housing;

a pair of bulb contact springs, each spring being mounted on a respective bulb contact member and extending towards the exit of the operator housing; and a contact unit extending across the open rear of the housing and including a. a substrate with a first pair of spaced contact termination areas on a surface thereof that faces toward the plunger, b. a flexible membrane spaced from and spanning across the first contact termination areas on the substrate, with a shorting surface disposed on the membrane opposite the first contact termination areas and being adapted to electrically bridge the areas upon deflection of the membrane, c. a second pair of contact termination areas disposed on the front side of the flexible membrane and facing into the exit of the operator housing, each of these termination areas being positioned for contact with a respective bulb contact spring, d. a pair of switch terminals mounted on the contact unit, each switch terminal being electrically connected to a respective first contact termination area, and e. a pair of lighting circuit terminals mounted on the contact unit, each terminal being electrically connected to a respective second contact termination area to complete a lighting circuit within the switch;

wherein the contact unit is seated against the open rear of the housing with the shorting surface on the membrane being in the path of travel of the distal end of the plunger.

* * * * *

UNITED STATES PATENT AND TRADEMARK OFFICE

CERTIFICATE OF CORRECTION

PATENT NO. : 4,350,857

DATED : September 21, 1982

INVENTOR(S) : Gary C. Fillus and Eric W. Long

It is certified that error appears in the above—identified patent and that said Letters Patent is hereby corrected as shown below:

Col. 11, line 48 "tht" should be --that--.

Col. 12, line 8 "srping" should be --spring--.

Signed and Sealed this

Third Day of May 1983

[SEAL]

*Attest:*

GERALD J. MOSSINGHOFF

*Attesting Officer*

*Commissioner of Patents and Trademarks*